US009031483B2

(12) United States Patent
Yamamoto et al.

(10) Patent No.: US 9,031,483 B2
(45) Date of Patent: May 12, 2015

(54) FIXING DEVICE WITH SHEET SEPARATING DEVICE THAT USES COMPRESSED GAS AND IMAGE FORMING APPARATUS

(75) Inventors: Takeshi Yamamoto, Kanagawa (JP); Fumihiro Hirose, Kanagawa (JP); Takashi Seto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/979,079

(22) PCT Filed: Mar. 12, 2012

(86) PCT No.: PCT/JP2012/056798

§ 371 (c)(1),
(2), (4) Date: Jul. 10, 2013

(87) PCT Pub. No.: WO2012/124797

PCT Pub. Date: Sep. 20, 2012

(65) Prior Publication Data

US 2013/0294802 A1 Nov. 7, 2013

(30) Foreign Application Priority Data

Mar. 16, 2011 (JP) ..... 2011-057925

(51) Int. Cl.
*G03G 15/20* (2006.01)

(52) U.S. Cl.
CPC .... *G03G 15/2028* (2013.01); *G03G 2215/0129* (2013.01); *G03G 2215/2032* (2013.01)

(58) Field of Classification Search
USPC ..... 399/323, 398, 399
See application file for complete search history.

(56) References Cited

U.S. PATENT DOCUMENTS

| | | | | |
|---|---|---|---|---|
| 3,955,813 | A | 5/1976 | Edwards | |
| 4,168,830 | A * | 9/1979 | Hori et al. | 271/176 |
| 4,592,651 | A | 6/1986 | Oikawa et al. | |
| 4,640,611 | A | 2/1987 | Ohdake et al. | |
| 4,919,531 | A | 4/1990 | Mashiko et al. | |

(Continued)

FOREIGN PATENT DOCUMENTS

| | | |
|---|---|---|
| JP | 51-104350 | 9/1976 |
| JP | 03-032878 | 2/1991 |

(Continued)

OTHER PUBLICATIONS

International Search Report issued Apr. 24, 2012 in PCT/JP2012/056798 filed Mar. 12, 2012.

*Primary Examiner* — G. M. Hyder
(74) *Attorney, Agent, or Firm* — Oblon, McClelland, Maier & Neustadt, L.L.P.

(57) ABSTRACT

A sheet separating device is attached to a fixing device. The fixing device includes: a fixing member that is a rotary body having a heating unit; and a pressing member that is pressed against and is brought into contact with the fixing member. The fixing device conveys a sheet material that carries unfixed toner thereon through a nip section formed by the fixing member and the pressing member so as to fix the unfixed toner image to the sheet material. The sheet separating device includes: at least one nozzle member that discharges compressed gas from the direction of a nip outlet toward the nip section along the fixing member. The nozzle member is rotatably supported by a shaft member that is provided parallel to the fixing member and includes a gas flow passage through which compressed gas is supplied to the nozzle member.

11 Claims, 4 Drawing Sheets

(56) References Cited

U.S. PATENT DOCUMENTS

| | | | | |
|---|---|---|---|---|
| 5,060,012 | A | 10/1991 | Seto et al. | |
| 5,263,698 | A | 11/1993 | Higuchi et al. | |
| 5,521,679 | A | 5/1996 | Miyakawa et al. | |
| 6,345,170 | B1 | 2/2002 | Nakazato et al. | |
| 6,839,537 | B2 * | 1/2005 | Mouri et al. | 399/323 |
| 8,249,491 | B2 | 8/2012 | Hirose et al. | |
| 8,433,230 | B2 | 4/2013 | Seto et al. | |
| 8,553,238 | B2 * | 10/2013 | Hirose et al. | 358/1.1 |
| 2004/0120735 | A1 | 6/2004 | Baba et al. | |
| 2005/0002054 | A1 | 1/2005 | Shoji et al. | |
| 2005/0154562 | A1 | 7/2005 | Matsuura et al. | |
| 2005/0157327 | A1 | 7/2005 | Shoji et al. | |
| 2006/0257183 | A1 | 11/2006 | Ehara et al. | |
| 2007/0008395 | A1 | 1/2007 | Masubuchi et al. | |
| 2007/0127934 | A1 | 6/2007 | Shoji et al. | |
| 2007/0147912 | A1 * | 6/2007 | Fujii | 399/323 |
| 2007/0212126 | A1 | 9/2007 | Seto et al. | |
| 2007/0212129 | A1 | 9/2007 | Takemoto et al. | |
| 2007/0218386 | A1 | 9/2007 | Suzuki et al. | |
| 2008/0008505 | A1 | 1/2008 | Seto et al. | |
| 2008/0069610 | A1 | 3/2008 | Nakafuji et al. | |
| 2008/0199229 | A1 | 8/2008 | Fujita et al. | |
| 2008/0219717 | A1 | 9/2008 | Kayahara et al. | |
| 2008/0219718 | A1 | 9/2008 | Fujita et al. | |
| 2009/0003897 | A1 | 1/2009 | Yamada | |
| 2009/0003898 | A1 | 1/2009 | Kayahara et al. | |
| 2009/0016786 | A1 | 1/2009 | Suzuki et al. | |
| 2009/0110449 | A1 * | 4/2009 | Saito et al. | 399/328 |
| 2009/0116880 | A1 | 5/2009 | Takagaki et al. | |
| 2009/0274492 | A1 * | 11/2009 | Ishikawa | 399/323 |
| 2009/0297199 | A1 | 12/2009 | Yamashina et al. | |
| 2010/0014897 | A1 | 1/2010 | Seto et al. | |
| 2010/0014903 | A1 | 1/2010 | Seto et al. | |
| 2010/0232844 | A1 | 9/2010 | Saito et al. | |
| 2010/0239292 | A1 | 9/2010 | Fujita et al. | |
| 2011/0164904 | A1 | 7/2011 | Hirose et al. | |
| 2011/0182609 | A1 | 7/2011 | Hasegawa et al. | |
| 2011/0206425 | A1 | 8/2011 | Seto et al. | |
| 2011/0217091 | A1 | 9/2011 | Hirose et al. | |
| 2012/0014725 | A1 | 1/2012 | Seto et al. | |
| 2012/0044516 | A1 | 2/2012 | Hirose et al. | |
| 2012/0045260 | A1 | 2/2012 | Yamamoto et al. | |
| 2012/0051805 | A1 | 3/2012 | Suzuki et al. | |
| 2012/0224893 | A1 | 9/2012 | Yamamoto et al. | |

FOREIGN PATENT DOCUMENTS

| | | |
|---|---|---|
| JP | 11-334191 | 12/1999 |
| JP | 2004-212954 | 7/2004 |
| JP | 2005-157179 | 6/2005 |
| JP | 2007-079411 | 3/2007 |
| JP | 2007-187715 | 7/2007 |
| JP | 2007-189015 | 7/2007 |
| JP | 2007-199462 | 8/2007 |
| JP | 2007-240920 | 9/2007 |
| JP | 2008-102408 | 5/2008 |
| JP | 2008-224833 | 9/2008 |
| JP | 2009-031759 | 2/2009 |
| JP | 2009-271115 | 11/2009 |
| JP | 2009-300704 | 12/2009 |

* cited by examiner

FIXING DEVICE WITH SHEET SEPARATING DEVICE THAT USES COMPRESSED GAS AND IMAGE FORMING APPARATUS

TECHNICAL FIELD

The present invention relates to a sheet separating device, a fixing device, and an image forming apparatus, more particularly, to a sheet separating device that discharges compressed gas so as to separate a sheet from a fixing member, to a fixing device, and to an image forming apparatus.

BACKGROUND ART

An electrophotographic image forming apparatus includes a fixing device that applies heat and pressure to a sheet material, such as a sheet of paper, onto which a toner image has been transferred, so as to fix the toner image. There is a fixing device that has a heat-roller fixing system in which a nip section is formed by a fixing roller that has an internal heat source, such as a halogen heater, and by a pressing roller that is in contact with the fixing roller; and the sheet material to which the transferred toner image has not been fixed is conveyed through the nip section so that the unfixed toner image is fixed to the sheet material.

Furthermore, a fixing device that has a belt-fixing system is also used, in which a ring-shaped fixing belt is extended between a heater roller that has an internal halogen heater, or the like, and a fixing roller that is located adjacent to the heater roller; a nip section is formed by the fixing belt and a pressing roller that is in contact with the fixing roller via the fixing belt; and the sheet material to which the transferred toner image has not been fixed is conveyed through the nip section, whereby the unfixed toner image is fixed to the sheet material.

The fixing device that has this fixing-belt system mentioned above offers advantages in that, because of the low heat capacity of the fixing belt, warming-up time can be shortened and power consumption can be suppressed.

In the fixing device, the toner image that adheres to the sheet material is brought into contact with the fixing roller and the fixing belt; therefore, the surfaces of the fixing roller and the fixing belt are coated with a fluorinated resin that provides superior separation performance, and a separation claw is used to separate the sheet material.

The major disadvantage in using the separation claw is in that, as the separation claw is brought into contact with the fixing roller and the fixing belt, the surfaces of the fixing roller and the fixing belt can easily receive a claw mark (claw scar) and, if the fixing roller, or the like, is damaged, a line occurs on the image output to the sheet material.

Usually, in the case of black-and-white image forming apparatuses, a metallic roller whose surface is coated with silicone resin is used as the fixing roller; therefore, even if the separation claw is brought into contact with the fixing roller, it is hard for the fixing roller to be damaged and the operating life can be longer. Color image forming apparatuses use silicone rubber coated with fluorine for the surface layer (generally a PFA tube of several dozen micrometers is used) or use silicone rubber with oil applied to its surface, whereby improving the colors.

However, a fixing roller that has the above configuration has a problem in that the surface layer is soft and easily becomes damaged. If the surface layer becomes damaged, a linear scar occurs on the fixed image. Therefore, nowadays, many color image forming apparatuses do not use a contact unit, such as a separation claw, and most of them perform non-contact separation.

For non-contact separation, if the adhesion between the toner and the fixing roller is strong, the fixed sheet of paper easily becomes wrapped around the roller and jammed; therefore, a wrapping jam easily occurs. Particularly with color image formation, a number of toner layers are formed and, because of the increased adhesion, a wrapping jam easily occurs.

Nowadays, color image forming apparatuses mainly use the following systems (1) to (3) for sheet separation:

(1) A non-contact separation plate system in which a small gap (about 0.2 mm to 1.0 mm) is provided between the fixing roller and the fixing belt; and separation plates are used that are arranged parallel to the fixing roller and the fixing belt in the longitudinal direction and the cross direction.

(2) A non-contact separation claw system in which a small gap (about 0.2 mm to 1.0 mm) is provided between the fixing roller and the fixing belt; and separation claws are used that are arranged at a predetermined interval.

(3) A self-stripping system in which a sheet of paper is naturally separated due to the rigidity of the paper and the elasticity of the curved portions of the fixing roller and the fixing belt.

In any of the above-described systems (1) to (3), however, a clearance is provided for a sheet guide plate guiding to the fixing outlet; therefore, when a thin sheet of paper or a sheet material that has a small margin at its end is delivered, or when a sheet material on which a solid image such as a picture is formed is delivered, the sheet material passes through the clearance while it adheres to the fixing roller or the fixing belt. Thus, a sheet wrapping jam may occur, or a jam may occur because the sheet hits the separation plate or the separation claw.

In order to ensure non-contact separation of a sheet material, a technology for spraying compressed gas, such as air, at the sheet separation position has been disclosed and is used (see, e.g., Patent Literature 1, Patent Literature 2, Patent Literature 3, Patent Literature 4, Patent Literature 5, and Patent Literature 6, which will be described below). According to the above, compressed air is sprayed at the gap between the fixed toner image on the sheet of paper and the fixing member so that the sheet is forcibly separated from the fixing member.

In recent years, it has become typical with color electrophotographic toner that when a large amount of toner is attached to the sheet material, it is required to increase the accuracy with which compressed air is sprayed in order to ensure removal of the sheet material from the fixing sheet. Therefore, it is necessary to accurately maintain the positional relation between the nozzle member that sprays compressed air and the surface of the fixing member. Specifically, the gap between the end of the nozzle member and the fixing member is kept constant regardless of the rotary movement of the fixing member and thermal expansion of the fixing member.

Patent Literature 7, which will be described below, discloses a technology for dealing with the oscillation of the surface of a fixing member that is a rotary body or a change in the diameter of the fixing member due to thermal expansion so as to accurately maintain the gap between the non-contact separation claw and the surface of the fixing member. A positioning plate is brought into contact with and is pressed against the surface of the fixing member so that the positioning plate oscillates such that the gap between the end of the non-contact separation claw and the fixing member is kept constant.

[Patent Literature 1] Japanese Patent Application Laid-open No. S51-104350

[Patent Literature 2] Japanese Patent No. 2876217

[Patent Literature 3] Japanese Patent Application Laid-open No. H11-334191

[Patent Literature 4] Japanese Patent Application Laid-open No. 2007-189015

[Patent Literature 5] Japanese Patent Application Laid-open No. 2007-240920

[Patent Literature 6] Japanese Patent Application Laid-open No. 2008-102408

[Patent Literature 7] Japanese Patent Application Laid-open No. 2009-31759

However, the technology disclosed in Patent Literature 7 can not be applied to the fixing device that includes a nozzle member without making changes to the technology.

There is a need to provide a sheet separating device that is capable of accurately maintaining the positional relation between the nozzle member and the fixing member, wherein the nozzle member sprays compressed gas at the gap between the fixed sheet material and the fixing member so as to separate the sheet, and to provide a fixing device and an image forming apparatus.

DISCLOSURE OF INVENTION

In an embodiment, a sheet separating device is attached to a fixing device. The fixing device includes: a fixing member that is a rotary body having a heating unit; and a pressing member that is pressed against and is brought into contact with the fixing member. The fixing device conveys a sheet material that carries unfixed toner thereon through a nip section formed by the fixing member and the pressing member so as to fix the unfixed toner image to the sheet material. The sheet separating device includes: at least one nozzle member that discharges compressed gas from the direction of a nip outlet toward the nip section along the fixing member. The nozzle member is rotatably supported by a shaft member that is provided parallel to the fixing member and includes a gas flow passage through which compressed gas is supplied to the nozzle member.

BEST MODE(S) FOR CARRYING OUT THE INVENTION

In a fixing device according to an embodiment, a shaft member has a gas flow passage inside it and a nozzle member can oscillate around the shaft member as its rotation axis, so that the tube passage of compressed gas is prevented from being moved and, as a result, the gap between the nozzle member that is connected to the tube passage and the fixing member does not change. Furthermore, in order to accurately maintain the size of the gap between the nozzle member and the surface of the fixing member, a positioning plate is in direct contact with the surface of the fixing member so that the shaft member and the nozzle member oscillate. Moreover, the nozzle member is arranged such that the size of the narrowest area of clearance between the nozzle member and the fixing member is equal to or less than 2.0 mm, whereby it is possible to effectively separate the sheet material.

In order to prevent scrapes on the fixing member from affecting the fixed image, the contact point of the positioning plate that is in contact with the fixing member is located outside the area where the largest image is formed. Moreover, if the fixing member and the pressing member are configured as roller-shaped rotary bodies, an air injection member can be used only in the area for conveying sheets at the fixing outlet, and the flexibility for arrangement of the nozzle member is limited; therefore, the nozzle member has a tapered shape and it includes a compressed gas passage that is tapered toward the injection port.

Moreover, a position adjustment mechanism is provided to perform adjustment to prevent variations in the set clearance between the end of the nozzle and the fixing member even if the temperature is high, if the fixing member is used of which error in the diameter is large, or if there is a dimension tolerance of a nozzle component or assembly variation. Furthermore, it is possible to prevent leakage of compressed air through the fitting clearance between the rotation shaft, which is a tube passage of compressed gas, and the nozzle member, and therefore it is possible to spray compressed gas in an effective and stable manner.

EMBODIMENTS

An explanation is given below of a sheet separating device, a fixing device, and an image forming apparatus according to an embodiment.

Figure 1:
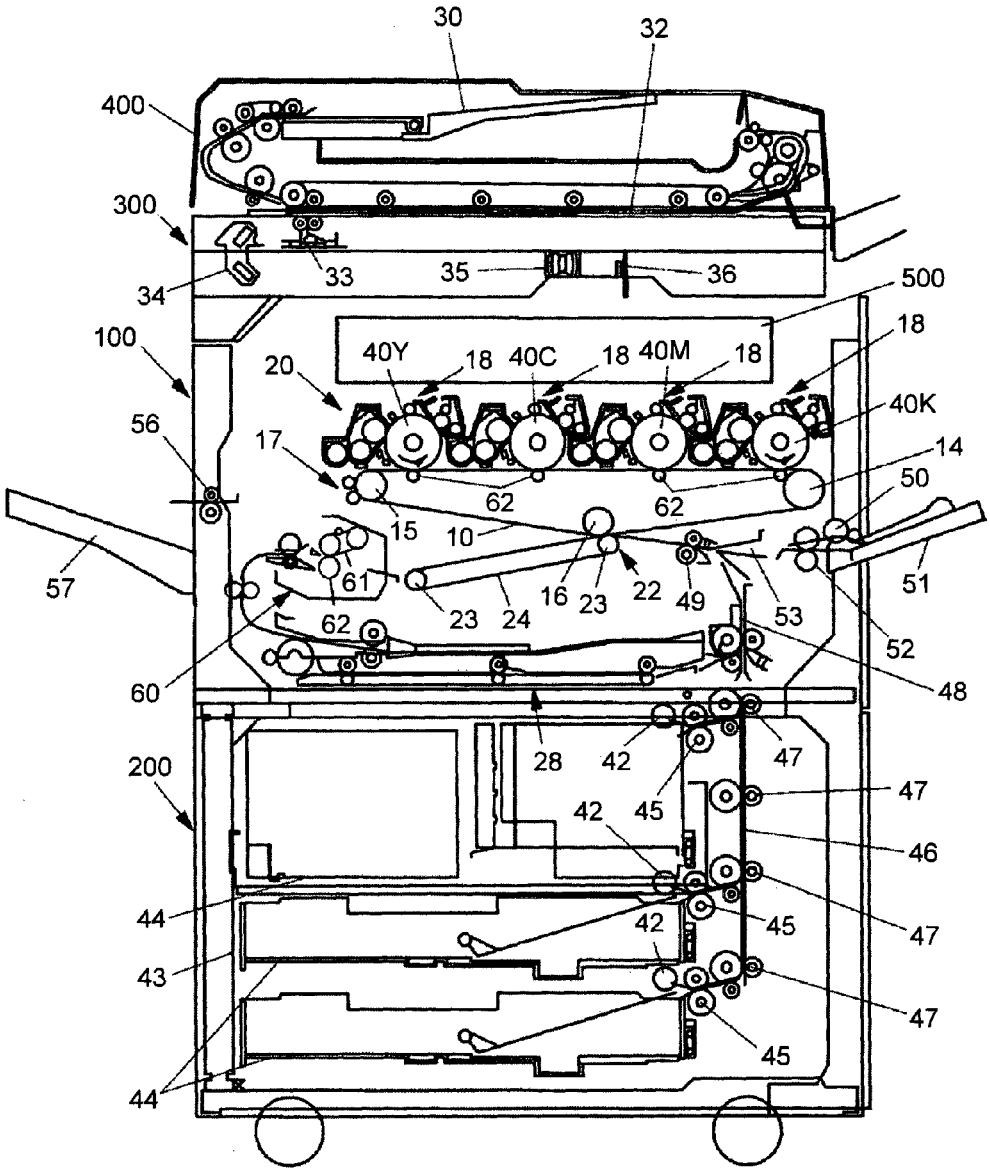
FIG. 1 is a schematic cross-sectional view that illustrates the configuration of an image forming apparatus according to an embodiment.

FIG. 1 is a schematic cross-sectional view that illustrates the configuration of the image forming apparatus according to the embodiment. In the drawing, the reference numeral 100 denotes a copier main body, the reference numeral 200 denotes a sheet feed table, the reference numeral 300 denotes a scanner, the reference numeral 400 denotes an automatic document feeder (ADF), and the reference numeral 500 denotes an exposure device. The copier main body 100 is placed on the sheet feed table 200, the scanner 300 is mounted on the copier main body 100, and the ADF 400 is further mounted on it.

An endless belt-like intermediate transfer member 10 is provided in the center of the copier main body 100, is extended by three supporting rollers 14, 15, 16, and is configured to rotate and move in the clockwise direction of the drawing. In this example, an intermediate-transfer-member cleaning device 17 is provided on the left of the second supporting roller 15 out of the three supporting rollers to remove residual toner that remains on the intermediate transfer member 10 after an image is transferred.

Four image forming units 18 for yellow, cyan, magenta, and black are located above the intermediate transfer member 10 between the first supporting roller 14 and the second supporting roller 15 out of the three supporting rollers and are arranged side by side along the conveying direction of the intermediate transfer member 10, whereby a tandem image forming device 20 is configured. The exposure device 500 is located above the tandem image forming device 20, as illustrated in the figure.

Furthermore, a secondary transfer device 22 is provided on the opposite side of the tandem image forming device 20 with the intermediate transfer member 10 interposed therebetween. In the illustrated example, the secondary transfer device 22 is configured such that a secondary transfer belt 24, which is an endless belt, is extended between two rollers 23, and the secondary transfer device 22 is arranged so that the secondary transfer belt 24 is pressed against the third supporting roller 16 via the intermediate transfer member 10, whereby an image on the intermediate transfer member 10 is transferred onto a sheet that is a transfer material.

A fixing device 60 is provided on the side of the secondary transfer device 22 to fix a transferred image to a sheet. The fixing device 60 is configured such that a pressing roller 62 is pressed against a fixing belt 61 that is an endless belt. The above-described secondary transfer device 22 has a sheet conveying function whereby the sheet is conveyed to the fixing device 60 after the image has been transferred. It is obvious that a transfer roller or non-contact charger may be provided as the secondary transfer device 22; however, in such a case, it is difficult to also provide the sheet conveying function.

In the illustrated example, a sheet reverse device 28 is provided under the secondary transfer device 22 and the fixing device 60 and is arranged parallel to the above-described tandem image forming device 20 to turn over the sheet so that an image is recorded on both sides of the sheet.

An explanation is given of an operation to make a copy using the above color electrophotographic device. The original document is placed on an original-document board 30 of the automatic document feeder 400, or the automatic document feeder 400 is opened so that the original document is placed on a contact glass 32 of the scanner 300 and the automatic document feeder 400 is closed to press the original document.

The scanner 300 is driven to move a first carrier 33 and a second carrier 34 immediately after an undepicted start switch is pressed if the original document has been placed on the contact glass 32 or, conversely, after the original document is conveyed to the contact glass 32 if the original document has been placed on the automatic document feeder 400. Light is emitted by a light source in the first carrier 33, and the light reflected by the document surface is further reflected so that the light enters the second carrier 34. The light is then reflected by a mirror in the second carrier 34, and the reflected light enters a read sensor 36 via an imaging lens 35, whereby the contents of the original document are read.

Furthermore, when the undepicted start switch is pressed, one of the supporting rollers 14, 15, 16 is driven and rotated by an undepicted drive motor so that the other two supporting rollers follow and rotate, whereby the intermediate transfer member 10 is rotated and moved. Simultaneously, photoreceptors 40K, 40Y, 40C are rotated by the individual image forming units 18 so that single-color images in black, yellow, magenta, and cyan are formed on the photoreceptors 40K, 40Y, 40C, 40M, on which latent images have been formed due to the exposure by the exposure device 500. While the intermediate transfer member 10 is moved, the single-color images are sequentially transferred so that a combined color image is formed on the intermediate transfer member 10

Furthermore, when the undepicted start switch is pressed, one sheet feed roller 42 in the sheet feed table 200 is selected and rotated and the sheet is fed from one of multiple sheet feed cassettes 44 included in a paper bank 43. The sheets are separated one by one by a separating roller 45, and the sheet is conveyed to a sheet feed path 46, conveyed by conveying rollers 47, guided into a sheet feed path 48 in the copier main body 100, and is stopped when the sheet hits a registration roller 49. If the sheet is fed from a manual feed tray 51, a sheet feed roller 50 is rotated so that the sheet on the manual feed tray 51 is fed, the sheets are separated one by one by a separating roller 52 so that the sheet is delivered to a manual sheet feed path 53 and is then stopped when the sheet hits the registration roller 49 in the same manner.

The registration roller 49 is rotated with the same timing as the combined color image on the intermediate transfer member 10; the sheet is conveyed into the gap between the intermediate transfer member 10 and the secondary transfer device 22; and then the image is transferred by the secondary transfer device 22 so that a color image is recorded on the sheet.

After the image has been transferred, the sheet is conveyed to the fixing device 60 by the secondary transfer device 22. After the fixing device 60 applies heat and pressure to fix the transferred image, the sheet is discharged by a discharge roller 56 due to switching of a switching claw 55, and is then stacked on a discharge tray 57. Alternatively, the sheet is conveyed to the sheet reverse device 28 due to switching of the switching claw 55, whereby the sheet is turned over and is guided to the transfer position again. After an image is recorded on the back side, the sheet is discharged to the discharge tray 57 by the discharge roller 56.

Furthermore, after the image has been transferred, the intermediate-transfer-member cleaning device 17 removes residual toner that remains on the intermediate transfer member 10 so that the intermediate transfer member 10 stands by for the tandem image forming device 20 to form an image again.

Figure 2:
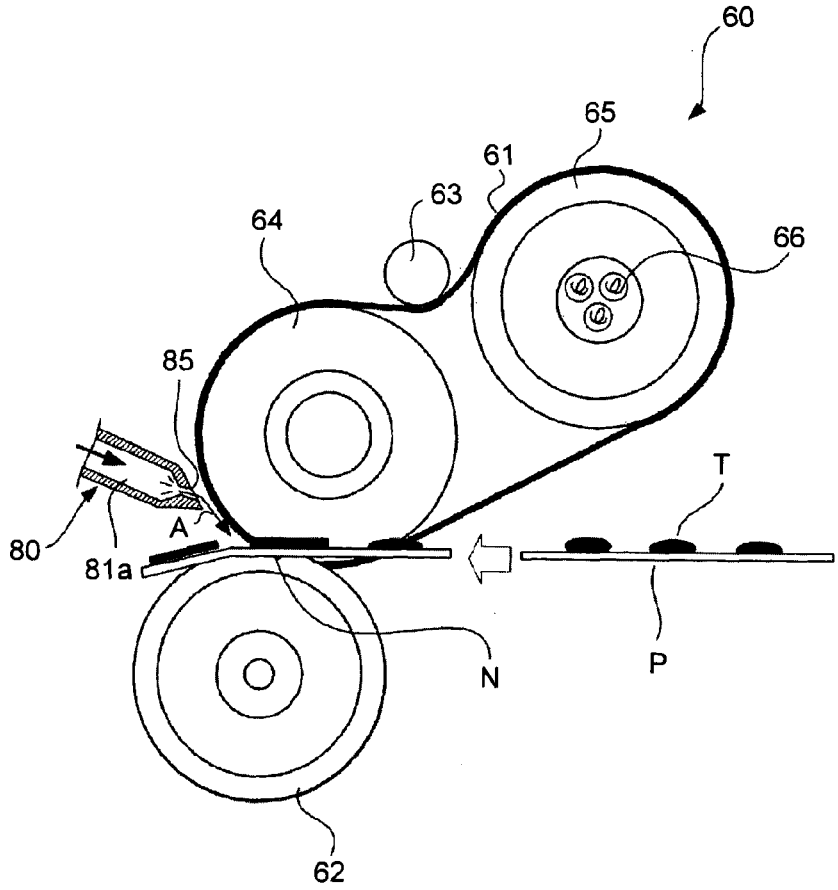
FIG. 2 is a schematic diagram that illustrates a fixing device according to the embodiment.

Next, an explanation is given of the fixing device 60 according to the embodiment. FIG. 2 is a schematic diagram that illustrates the fixing device according to the embodiment. In the fixing device 60, the fixing belt 61 that is a fixing member is extended between a fixing roller 64 that is a driving roller and a heating roller 65 that is a driven roller so that the fixing belt 61 rotates and moves.

The pressing roller 62 is opposed to the fixing roller 64 via the fixing belt 61. An undepicted pressing mechanism presses the pressing roller 62 against the fixing roller 64 via the fixing belt 61 so that a nip section N is formed. A fixing heater 66 is provided as a heat source in the heating roller 65. The heating roller 65 is heated by the fixing heater 66, and the fixing belt 61 is heated by the heating roller 65. The fixing roller 64 is driven and rotated by an undepicted drive mechanism so that the fixing belt 61 is rotated and then the pressing roller 62 is rotated together with the fixing belt 61. It is possible to drive the pressing roller 62.

An undepicted temperature detecting element detects the surface temperature of the fixing belt 61, and an undepicted temperature control unit controls the fixing heater 66 in accordance with the output value of the temperature detecting element so that the surface temperature of the fixing belt 61 becomes a predetermined temperature.

When an unfixed sheet material P passes through the fixing nip section N that is formed by the fixing belt 61, whose temperature is controlled to be a predetermined temperature, and the pressing roller 62, a toner image T is melted and fixed, and then the sheet material P is delivered out of the device main body. Although the pressing roller 62 is used as a pressing member, a pressing belt, or the like, may be used.

According to the embodiment, a tension roller 63 is provided on the outer side of the fixing belt 61 to maintain the tension of the fixing belt 61. The tension roller 63 may be provided at the inner side or the outer side of the fixing belt 61. The fixing device may be not only a belt fixing device but also what is called a roller fixing device that includes a pair of rollers, i.e., a fixing member that includes a heat source and a pressing member that is pressed by it.

A nozzle member 80 is provided near the outlet of the fixing nip section N in the fixing device 60. The nozzle member 80 includes an air ejection port 85 and is arranged in a sheet separating device (see FIG. 3). In the fixing device according to the embodiment, multiple nozzle members 80 are arranged such that the narrowest area of the clearance between the nozzle member 80 and the fixing belt 61 is equal to or less than 2.0 mm. Only the end of the nozzle member 80 is schematically illustrated in FIG. 2. Furthermore, the nozzle member 80 may be arranged parallel to a non-contact separation claw (also referred to as a separation plate).

Compressed airflow A, which is controlled by an undepicted compressed-air supply source and an undepicted electromagnetic valve, passes through an end-section air passage 81*a* of the nozzle member 80 and is then sprayed toward the fixing nip section N from the air ejection port 85. The end of the sheet material P is forcibly separated from the fixing belt 61 due to the compressed airflow.

Figure 3:
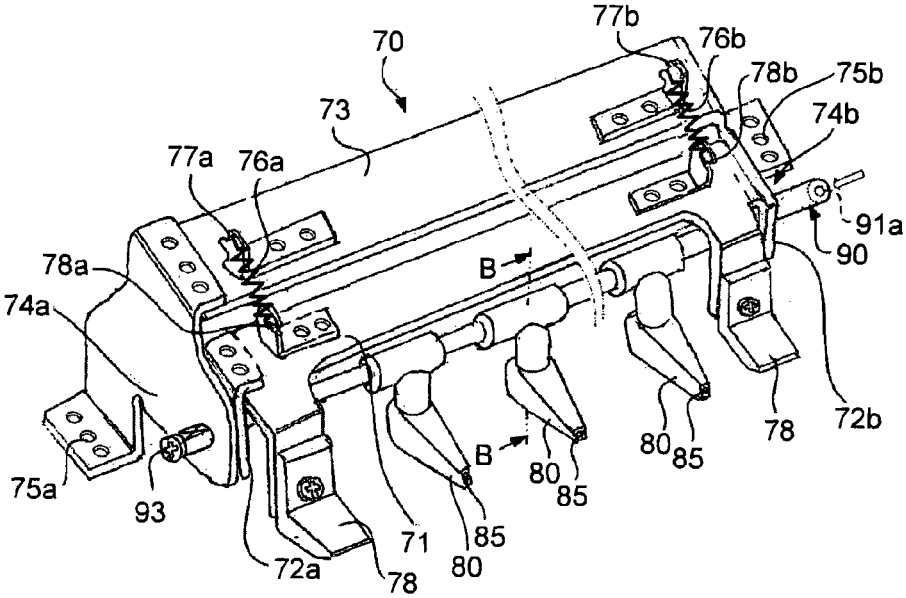
FIG. 3 is a perspective view of a sheet separating device according to the embodiment.
Figure 4:
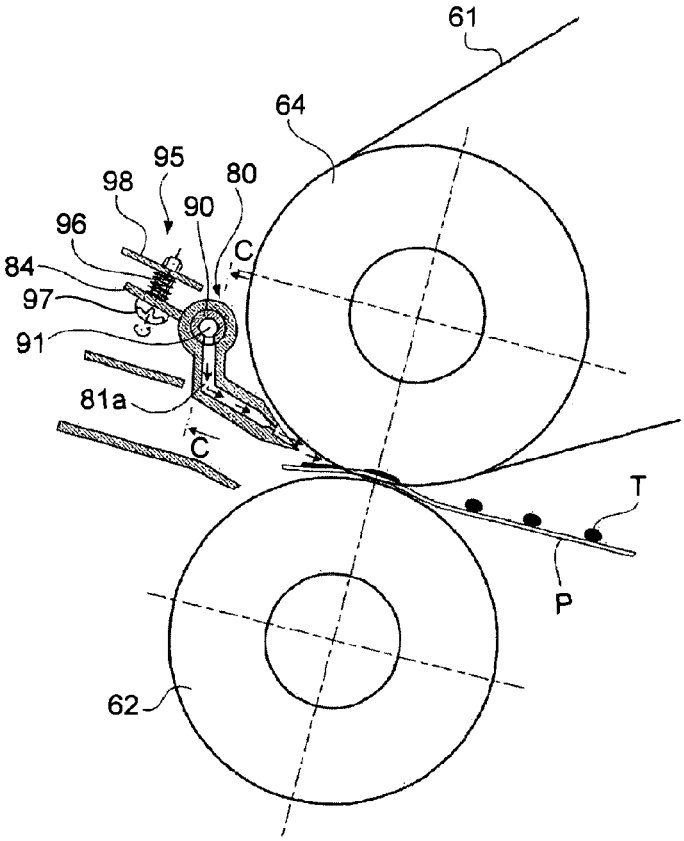
FIG. 4 is a perspective view that illustrates a compressed-air ejection nozzle member.
Figure 5:
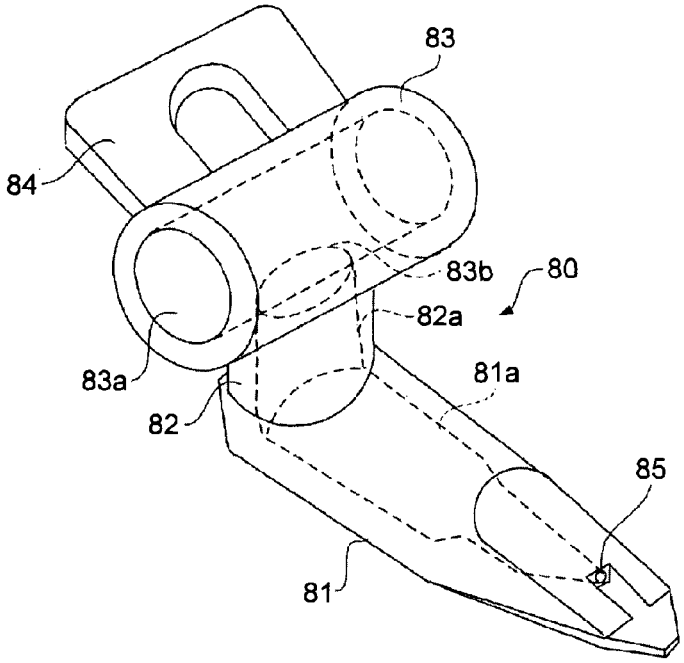
FIG. 5 is a cross-sectional view of the nozzle member in the sheet separating device taken along the line B-B of FIG. 3.
Figure 6:
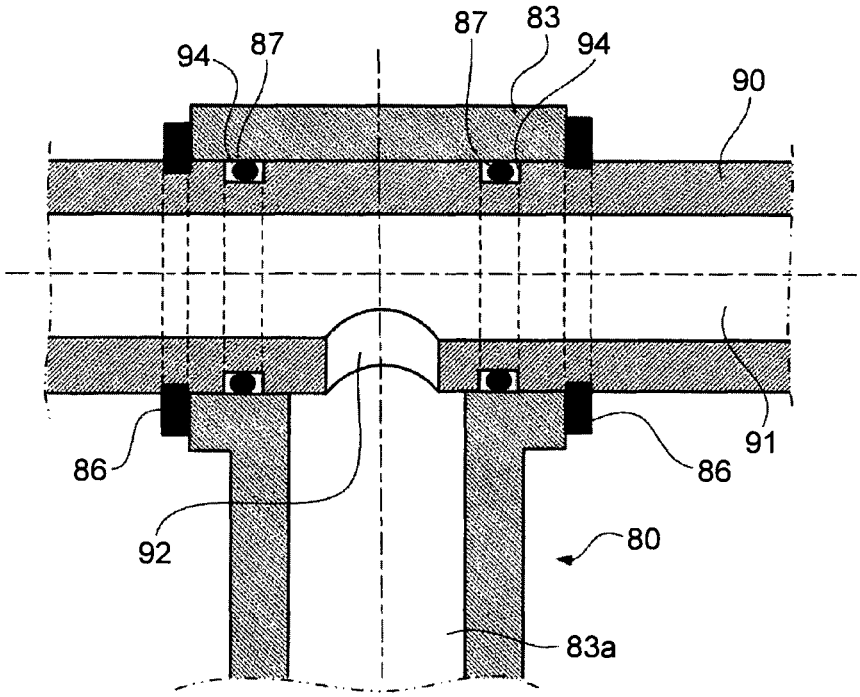
FIG. 6 is a perspective view that illustrates the nozzle member in the sheet separating device.
Figure 7:
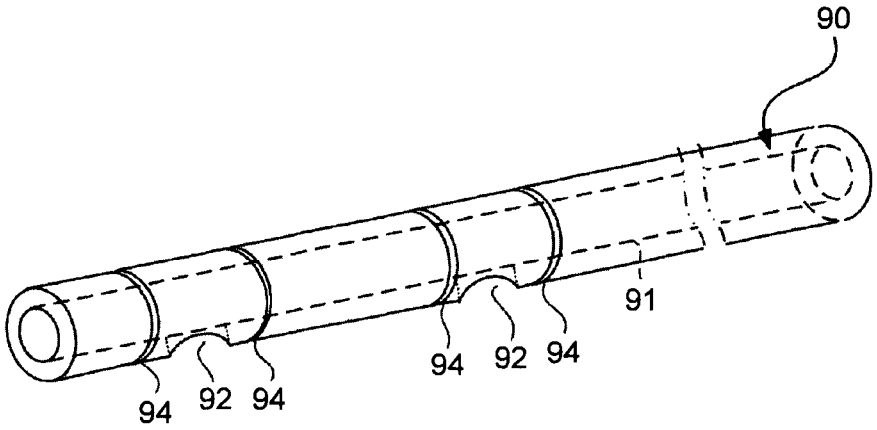
FIG. 7 is a perspective view that illustrates a shaft member in the sheet separating device.

Next, an explanation is given of a sheet separating device 70 where the nozzle member 80 is arranged. FIG. 3 is a perspective view of the sheet separating device according to the embodiment; FIG. 4 is a cross-sectional view of the nozzle member in the sheet separating device taken along the line B-B of FIG. 3; FIG. 5 is a perspective view that illustrates the nozzle member in the sheet separating device; FIG. 6 is a cross-sectional view of the sheet separating device taken along the line C-C of FIG. 4; and FIG. 7 is a perspective view that illustrates a shaft member in the sheet separating device.

Multiple nozzle members 80 are arranged along the longitudinal direction of the fixing roller 64. Only one nozzle member 80 may be arranged in the middle along the cross direction of the fixing roller 64.

As illustrated in FIG. 3, the nozzle member 80 is supported by a shaft member 90. The shaft member 90 is a tube-shaped member in which a gas passage 91 is formed to supply compressed air that is compressed gas. An opening 92 is formed on the shaft member 90 to supply compressed air to the nozzle member 80. The opening 92 communicates with the gas passage 91, and the number of openings 92 corresponds to the number of nozzle members 80 attached (see FIG. 7).

The shaft member 90 is preferably made of a material that is resistant to decay, such as stainless steel (SUS) or an aluminum alloy. Because drain occurs due to the compressed air, decay due to the drain needs to be prevented. If SUM (sulfur and sulfur compound free-cutting steel) or the like is used, it is also necessary to perform plating on the inner wall of the tube passage to prevent decay. Furthermore, one side (the left side in the drawing) of the gas passage 91 of the shaft member 90 is sealed by a screw 93. If the screw 93 is wrapped with a thin PTFE sheet or an adhesive material is applied to the screw 93, the sealing performance is improved. According to the present embodiment, the screw 93 is fastened to seal the opening of the gas passage 91; however, sealing may be performed by using a method such as welding or glueing if the opening of the gas passage 91 is sealed.

Compressed air is supplied through an opening 91*a* on the other end (on the right side in the drawing) of the shaft member 90 (the arrow in FIG. 3). The shaft member 90 is supported by being inserted through side plates 72*a*, 72*b* of a movable stay 71. The shaft member 90 is retained by a D-shaped opening in one or both side plates 72*a*, 72*b* so that the shaft member 90 is fixed and is not rotated with respect to the movable stay 72. The outline shape of the shaft member 90 in the part that is attached to the movable stay 72 is also a D-shape in cross-section.

Positioning plates 78 are attached to the movable stay 72, and the positioning plates 78 are pressed toward the fixing roller 64. The end of the positioning plate 78 is in contact with the fixing roller 64 outside its maximum image fixed area. The positioning plate 78 oscillates in accordance with the thermal expansion or oscillation of the fixing roller 64 so that the interval between the end of the nozzle member 80 and the fixing roller 64 is kept at a constant value that is a set value equal to or less than 2 mm.

The movable stay 71 is swingably supported by a fixed stay 73. Specifically, the shaft member 90 attached to the movable stay 71 is rotatably supported by side plates 74*a*, 74*b* of the fixed stay 73. Therefore, the movable stay 71 can swing around the shaft member 90 together with the positioning plates 78 in relation to the fixed stay 73.

The fixed stay 73 is fixed to the main body of the fixing device with a screw, or the like, through fixing sections 75*a*, 75*b*. Tension springs 76*a*, 76*b* are extended between the movable stay 71 and the fixed stay 73, and the positioning plates 78 are pressed toward the fixing roller 64. The ends of the tension spring 76*a* are attached to a projection 78*a* of the movable stay 71 and a projection 77*a* of the fixed stay 73, and the ends of the tension spring 76*b* are attached to a projection 78*b* of the movable stay 71 and a projection 77*b* of the fixed stay 73.

In the sheet separating device 70, the air ejection port 85 formed at the end of the nozzle member 80 has, for example, □0.5×0.5 mm (a square, 0.5 mm on a side) or Ø0.5 mm (0.5 mm in diameter) for a smaller one or □2.0×2.0 mm or Ø2 mm for a larger one, preferably set in the range between about 0.19 square millimeters at a minimum and 4.0 square millimeters at a maximum.

If compressed air is ejected toward the fixing nip section N from the fixing and discharging direction, it is necessary to arrange the nozzle member 80, which has a tube passage of compressed air, in the space for conveying sheets and in the space for the fixing roller 64. An experimental study has shown that, if the effective cross-sectional area of the air ejection port 85 is equal to or less than 0.19 square millimeters, a sufficient amount of compressed air for separation cannot be ejected; and conversely, if it is equal to or greater than 4.0 square millimeters, the flow passage of air becomes too wide and the air cannot be ejected with an adequate flow passage for separation.

Next, a detailed explanation is given of the nozzle member 80. In terms of heat resistance, the nozzle member 80 may be made of an engineering plastic, such as PPS (Polyphenylene sulfide), PEEK (polyether ether ketone), PET (polyethylene terephthalate), or PES (Polyethersulphone). Furthermore, if toner contamination of the end of the nozzle member 80 needs to be prevented, it is preferable to use PFA (tetrafluoroethylene/perfluoro alkyl vinyl ether copolymer) as the material or to apply PFA coating or PTFE (polytetrafluoroethylene (tetrafluoride)) coating to only an area that is to be contaminated. If the above coating is performed by burning, the material of the nozzle member 80 is preferably selected from materials, such as PEK (polyether ketone), PI (polyimide), or LCP (liquid crystalline polymer), which are resistant to burning.

The nozzle member 80 includes a tapered end section 81, on the end of which the air ejection port 85 is formed; a rising section 82 that rises from the base portion of the end section 81; a cylindrical attachment section 83 that is mounted on the rising section 82; and a plate-like member 84 that extends from the attachment section 83 in the direction opposite to the end section 81. An insert hole 83*a* is formed in the attachment section 83, through which the shaft member 90 is rotatably inserted. Furthermore, an attachment-section air passage 82*a* is formed in the rising section 82 and is communicated with the insert hole 83*a* of the attachment section 83. An end-section air passage 81*a* is formed in the end section 81 so that it communicates with the attachment-section air passage 82*a* and leads to the air ejection port 85.

The attachment-section air passage 82*a* and the end-section air passage 81*a* are collectively formed to be tapered. In the nozzle member 80 according to the embodiment, the effective cross-section of an opening 83*b* through which the attachment-section air passage 82*a* communicates with the insert hole 83*a* is Ø4 mm to Ø6 mm or has □4×4 mm to □6×6 mm.

Moreover, in the sheet separating device 70 according to the embodiment, an adjustment mechanism 95 is provided to adjust the positions of the fixing belt 61 and the air ejection port 85 of the nozzle member 80.

As illustrated in FIG. 4, the adjustment mechanism 95 includes a compression spring 96 that is a pressing member; a screw 97 (right-hand screw); and a stay 98 that supports the above components. The compression spring 96 is interposed between the stay 98 and the plate-like member 84 of the nozzle member 80 so that the position of the plate-like member 84 can be adjusted in relation to the stay 98. In the adjustment mechanism 95, when the screw 97 rotates in a clockwise direction about its axis, the nozzle member 80 rotates about its rotation axis, which is the shaft member 90, in a clockwise direction in the drawing so that the end moves away from the fixing belt 61. Conversely, if the screw 97 rotates in the counterclockwise direction, the nozzle member 80 rotates about its rotation axis, which is the shaft member 90, in a counterclockwise direction in the drawing so that the clearance between the nozzle member 80 and the fixing roller 64 becomes smaller.

With the adjustment mechanism 95, it is possible to adjust the positional relation between the air ejection port 85 of the nozzle member 80 and the fixing roller 64 or the fixing belt 61 so as to obtain the optimum value. The optimum value can be experimentally obtained.

As illustrated in FIG. 6, the shaft member 90 is inserted into the nozzle member 80, and the positions of the ends of the nozzle member 80 are set by E-rings 86 with respect to the shaft member 90. O-rings 87 are provided between the shaft member 90 and the attachment section 83 of the nozzle member 80 and are attached to the areas on two sides of the shaft member 90 with the opening 92 interposed therebetween, whereby leakage of compressed air from the gap between the nozzle member 80 and the shaft member 90 is prevented. The O-ring 87 is provided in a groove 94 that is formed on the outer circumference of the shaft member 90.

According to the present embodiment, when the fixing roller 64 rotates and oscillates, the positioning plates 78 that are pressed against the surface of the fixing roller 64 oscillate in accordance with the movement of the fixing roller 64, and the movable stay 71 attached to the positioning plates 78 as well as the shaft member 90 make a back-and-forth oscillating movement in synchronization with the fixing roller 64.

Due to the oscillating movement of the shaft member 90, the nozzle member 80 oscillates; therefore, the distance between the fixing roller 64 and the nozzle member 80 is always kept constant so that compressed air is ejected to the fixing roller 64 in a stable manner and so that a problem can be prevented in that, because of a larger gap, the leading edge of a sheet of paper becomes stuck in the gap, which results in a paper jam.

As described above, in the image forming apparatus according to the present embodiment, the nozzle member is provided to spray compressed air at the gap between the fixed sheet material and the fixing member so as to separate the sheet, is rotatably supported by the shaft member, and is moved in accordance with the oscillation or thermal expansion of the fixing belt so that the clearance between the nozzle member and the fixing belt can be always constant, whereby it is possible to ensure separation of the sheet material from the fixing member.

According to the present embodiment, a nozzle member, which sprays compressed gas at the gap between the fixed sheet material and a fixing member so as to separate the sheet, is rotatably supported by a shaft member so that the positional relation between the nozzle member and the fixing member can be accurately maintained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A fixing device comprising:

a fixing member that is a rotary body having a heating unit;

a pressing member that is pressed against and is brought into contact with the fixing member; and a sheet separating device with at least one nozzle member that discharges compressed gas from the direction of a nip outlet toward the nip section along the fixing member, wherein the fixing device conveys the sheet material that carries unfixed toner thereon through a nip section formed by the fixing member and the pressing member so as to fix the unfixed toner image to the sheet material, the sheet separating device separates the sheet material from the fixing member, the nozzle member is rotatably supported by a shaft member that is provided parallel to the fixing member and includes a gas flow passage through which compressed gas is supplied to the nozzle member, and the shaft member is rotatably supported by side plates.

2. The fixing device according to claim 1, wherein the nozzle member is provided such that a size of the narrowest area of clearance between the nozzle member and the fixing member is equal to or less than 2.0 mm.

3. The fixing device according to claim 1, further comprising a positioning plate that is fixed to the shaft member and the nozzle member, wherein the positioning plate is pressed against a surface of the fixing member and is rotated so that the distance between the nozzle member and the surface of the fixing member is kept constant.

4. The fixing device according to claim 3, wherein the positioning plate is provided outside a maximum image fixed area of the fixing member.

5. The fixing device according to claim 1, wherein the nozzle member has a tapered shape and has a discharge port on its end, the discharge port having an effective cross-sectional area of 0.19 to 4.0 square millimeters, and a compressed-gas flow passage that leads to the discharge port has a shape such that the compressed-gas flow passage is tapered continuously or intermittently from a point that has a larger effective cross-sectional area to the discharge port.

6. The fixing device according to claim 1, wherein the nozzle member is arranged such that the nozzle member is capable of rotating around the shaft member, and the nozzle member is attached to the shaft member via an adjustment mechanism that adjusts the position of an end of the nozzle member in relation to the fixing member.

7. The fixing device according to claim 1, wherein two or more ring-shaped sealing members are provided in a fitting clearance between the nozzle member and the tube-shaped shaft member.

8. An image forming apparatus comprising:

the fixing device according to claim 1; and an image forming unit that forms an unfixed toner image on a sheet that is conveyed to the fixing device.

9. The fixing device according to claim 1, further comprising a fixed stay that is fixed to the fixing device, the fixed stay includes the side plates that rotatably support the shaft member.

10. The fixing device according to claim 9, further comprising a movable stay is swingably supported by the fixed stay by tension springs that are extended between the movable stay and the fixed stay.

11. The fixing device according to claim 10, further comprising a positioning plate that is attached to the movable stay, wherein the positioning plate is pressed against a surface of the fixing member and is rotated so that the distance between the nozzle member and the surface of the fixing member is kept constant.

* * * * *